United States Patent [19]

Becker

[11] 3,936,915

[45] Feb. 10, 1976

[54] CLOTH FEEDING DEVICE FOR TENTERING MACHINES

[75] Inventor: Arno Becker, Freudenstadt, Germany

[73] Assignee: Bruckner-Trockentechnik KG, Leonberg, Germany

[22] Filed: Dec. 11, 1974

[21] Appl. No.: 531,680

Related U.S. Application Data

[63] Continuation-in-part of Ser. No. 328,606, Feb. 1, 1973, abandoned.

[30] Foreign Application Priority Data

Feb. 24, 1972 Germany ..... 2208756
July 27, 1972 Germany ..... 2237014

[52] U.S. Cl. ..... 26/57 A; 26/57 E
[51] Int. Cl.² ..... D06C 3/02
[58] Field of Search ..... 26/57 A, 57 E; 226/3, 20

[56] References Cited

UNITED STATES PATENTS

| | | | |
|---|---|---|---|
| 2,088,984 | 8/1937 | Tandel | 26/57 E |
| 2,451,343 | 10/1948 | Kunzle | 26/57 E |
| 2,577,880 | 12/1951 | Dodge | 26/57 A |
| 2,601,713 | 7/1952 | Nield | 26/57 A |
| 2,961,735 | 11/1960 | Mehring | 26/57 A |
| 3,150,432 | 9/1964 | McCreary | 26/57 E |
| 3,670,375 | 6/1972 | Cohn et al. | 26/57 A |

FOREIGN PATENTS OR APPLICATIONS

| | | | |
|---|---|---|---|
| 1,416,788 | 9/1965 | France | 26/57 A |
| 1,077,961 | 3/1960 | Germany | 226/20 |
| 1,087,139 | 8/1960 | Germany | 226/20 |
| 700,857 | 12/1953 | United Kingdom | 26/57 E |

OTHER PUBLICATIONS

Leading American Mills Depend on Famatex Tenter Frames for Highest Production, Textile Industries, Apr. 1960, Robert Reiner, Inc., Weehawken, New Jersey.

*Primary Examiner*—Robert R. Mackey
*Attorney, Agent, or Firm*—Marshall & Yeasting

[57] ABSTRACT

A driven feed roller is disposed above a pair of needle chains. Members for spreading the web edges are located immediately preceding the feed roller, and a pair of needling rollers for impaling the web edges on the needle chains are located immediately following the feed roller in the direction of web movement. A device for sensing the web edges is arranged to scan the web edges on the feed roller.

10 Claims, 3 Drawing Figures

CLOTH FEEDING DEVICE FOR TENTERING MACHINES

CROSS-REFERENCE TO RELATED APPLICATION

This is a continuation-in-part of abandoned application Ser. No. 328,606, filed Feb. 1, 1973 and now abandoned.

BACKGROUND OF THE INVENTION

This invention relates to a tentering machine for a cloth web, comprising a driven feed roller for the cloth web disposed above the needle chains, and members for spreading the edges of the cloth web, and two driven needling rollers for applying the edges of the cloth web to the needle chains, together with a device for sensing the edge of the web.

In previously known tentering machines the cloth web feed roller is spaced in front of the needling position (needling rollers) in the entry area of the machine so that what are known as unrolling fingers may for instance be disposed between said roller and the needling rollers, for spreading the web edges, together with a device for scanning the edges of the cloth web. In such cases the feed roller is generally in a plane above that wherein the web is conveyed by the needle chains. A web to be needled thus easily runs with a downward inclination from the feed roller to the needling position; the web edges can be spread out by the spreading members, and the edge-sensing device can be used to set the two lateral needle chains (with their rails) to the present width of the incoming cloth web. Parallel with the width adjustment of the needle chains there is at the same time an adjustment of the needling roller disposed above each needle chain.

It has now been found that after leaving the feed roller a cloth web to be needled hangs arcuately across its width, and the spreading elements engaging the web edges do not affect this condition. Under these conditions, it is customary to arrange the chain rails diverging, and the spreading rollers are also strongly diverging and distort the web. With broad and heavy webs of cloth this arcuate hanging may have an effect such that the web under its own weight will slip out of the spreading members (e.g. unrolling fingers) and possibly out of the needling rollers. Nor can any support for the web in its central area, ignoring the constructional expense involved, do much to change this tendency.

When with these known constructions the control according to the width of the incoming cloth web is effected by the sensing device (at the edges of the web), because of the arcuate handing of the web firstly there can be no adaptation to the exact width, and secondly the web edges will run extremely unevenly and hence make sensing of such edges extremely difficult. This has the consequence that the gap adjustment for the two needle chains and hence of the two needling rollers is affected in a very unfavorable manner, with the chain guiding elements travelling much closer together than is necessary. Since the sensing device for the edges of the cloth web usually lies between the spreading members and the needling rollers, the web must also usually cover a considerable distance before it can be needled, so that the spreadout edges of the web can at least partly roll up again, and also in particular diverging of the chain rails makes a large difference between the width at the sensing position and at the needling position, making the needling imprecise.

SUMMARY OF THE INVENTION

The object of the invention is thus to construct a tentering machine of the class described in such a manner that a web of cloth to be treated can be needled in fully spread condition, avoiding any arcuate hanging across the width, while at the same time extremely precise control of the interval between the two needle chains or the two needling rollers is provided by the sensing device.

According to the invention this object is achieved in that the spreading members for the web edges, the feed roller and the needling rollers are disposed in close sequence in the direction of web feed, and in that the device for scanning the edges of the cloth web is so provided that the edges can be scanned on the feed roller.

With the construction provided by the invention the edges of the cloth web to be treated are first spread or rolled out (depending on the design of the members) by spreading members acting parallel to the feed roller. Immediately after spreading out of the web edges the web runs on to the feed roller which passes the web on to the closely following needle rollers and thus to the needling position. Because of the close succession of feed roller and needling rollers, the path of the cloth across the entire width is substantially identical with the path of the web edges to the needling points, and there is in practice no possibility of the web hanging arcuately over its width and possibly slipping out of the needling position, as happens with known tentering machines. Since the spreading members are located closely in front of the feed roller, renewed deflection or rolling in of the web edges is also effectively prevented.

Since, as already stated, the cloth web runs over the feed roller in fully broadened condition and is thence fed directly to the needling rollers, the edges of the cloth web travel with extreme steadiness in the area of the tentering machine inlet. Because of the well-controlled guidance of the web resting evenly on the feed roller there is notagitated "jerking" by the spreading members and hence no zig-zag movement of the web edges on to the needling rollers, as is the case with known constructions. The disposition of the sensing device at the feed roller in accordance with the invention thus has the consequence that the edges of the web and hence the width of the web can be sensed with great accuracy, so that in turn very precise and steady control of the interval between the two needle chains or the two needling rollers can be obtained.

According to a preferred embodiment of the invention it is often beneficial if the needling rollers above the web are in contact with the feed roller and are thus driven. In this way the feed roller can at the same time act as a contact and drive member for the needling rollers. There is thus achieved a considerable simplification from the constructional aspect; in particular there are no awkward drive elements for the needling rollers, and hence the danger of any soiling of the web (through grease or oil sprayed from such drive elements) is complelely obviated.

The principle on which the invention is based not only can be effectively applied to tentering machines with an undivided feed roller, but is also particularly suitable for tentering machines whose feed rollers have a number of separately adjustable roller portions so that distortion in the web (longitudinal or arcuate distortion) can be effectively corrected and the web is fed properly aligned onto the needle strips.

In many cases, however, it is also desirable in accordance with a further aspect of the invention that the two separately drivable needling rollers be located with a slight peripheral gap behind the feed rollers and can be conveyed transversely of the web with the device for adjusting the needle chain width. The conveyance of the web in accordance with the invention as described above is in no way affected by the resulting small gap; at the same time, however, the needling rollers can be displaced axially of the feed roller relatively unhindered, and their rotary speed is independent of the feed roller.

DESCRIPTION OF THE PREFERRED EMBODIMENTS

As stated above, the drawings show only the feed section of tentering machines in accordance with the invention, for a web of cloth 1.

Figure 1:
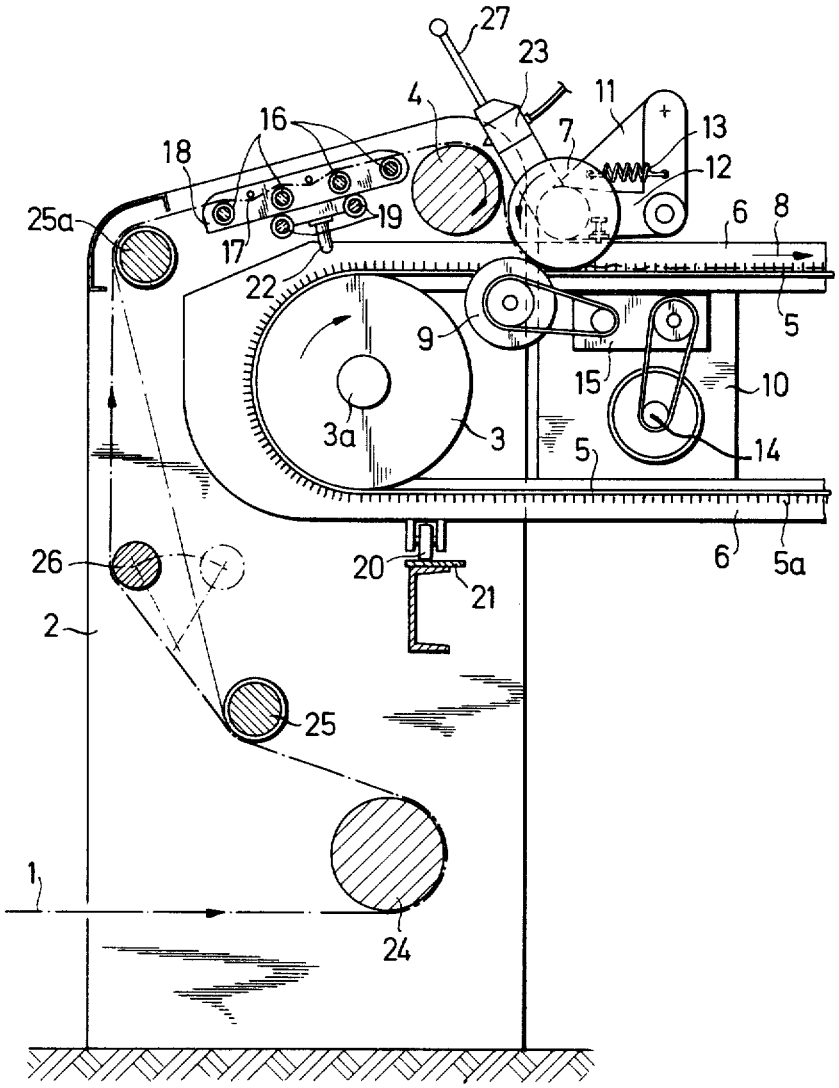
FIG. 1 is a simplified section through the feed portion of a tentering machine according to the invention, wherein the two needling devices are connected substantially rigidly to the corresponding chain rails.

The feed section shown in FIG. 1 comprises a frame 2 wherein a web feed roller 4 is disposed before the chain rail feed field and in the area above the needle chain reverser wheels 3. The reverser wheels 3 are used to reverse the tenter chains 5, each of which engages one edge of the cloth web, and in this case, for instance, has its needle members 5a running perpendicular to the horizontal plane in which the web is conveyed, and is supported in chain rails 6 (with an upper and lower chain rail on each side). The feed roller 4, which if desired can be divided axially into a number of roller portions, separately drivable and adjustable, extends transversely across the feed section of the tentering machine and lies with its geometrical axis generally parallel to the axes *3a* of the chain wheels.

In the area of each edge of the web of cloth is disposed a needling roller 7 which lies at a small peripheral interval behind the feed roller 4 taken in the direction of web travel (see arrow 8) and is disposed above a needle chain 5 in such manner that it impales the corresponding edge of the web 1 on the needle members *5a*. Each needling roller 7 is driven from below by frictional drive through a counter-pressure roller 9, said counter-pressure roller being held by a bearing plate 10 which is disposed between the upper and lower guide rails 6 of the corresponding tenter or needle chain 5 and is fixedly attached to these chain rails. Each needling roller 7 is supported on a bearing block 11 fixed to the corresponding upper chain rail 6, by means of a vertical pivoted lever which engages a tension spring 13 and a horizontal lever 12 pivotally connected to said vertical lever and carrying the needling roller 7, which is thus pressed by the spring 13 against the counter-pressure roller 9.

The drive for the counter-pressure roller 9 is provided for instance by a horizontal shaft 14 supported by the bearing plate 10, which is driven from the same source as the feed roller in order that the peripheral speed of the needling roller 7 may be proportional to that of the feed roller 4. Between the horizontal shaft 14 and the counter-pressure roller 9 is a relatively small variable speed drive 15 which is also mounted on the bearing plate 10. By means of this variable speed drive the needling rollers 7 can be adapted in speed to the condition (slack or taut) of the corresponding edges of the cloth web 1. This is also an advantage when the feed roller is of the divided type, so that inclined distortions of the web can be corrected.

As may also clearly be seen from FIG. 1, immediately in front of the feed roller 4 opposite the direction of web travel are four unrolling fingers 16 which are provided as spreading members for the web edges. Between the unrolling fingers 16 are disposed adjustable guide bars 17 which cause a greater or lesser embracement of the unrolling fingers 16 by the cloth web 1. The unrolling fingers 16 and guide bars 17 in the area of each edge of the web are preferably held in support loops 18 and are slideably mounted on two guide bars 19 which have their axes parallel to the feed roller 4 and extend across the feed section between the side walls of the frame 2 in the tentering machine.

In order to permit adjustment of the needle chains to the present width of the incoming cloth web 1, the distance between the two chain guide rails 6, perpendicular to the plane of the drawing in FIG. 1, is adjustable, with the chain guide rails 6 running with rollers 20 on guide tracks 21. Since for each needle chain 5 a needling device (with needling roller 7) is fixedly attached on the guide rail 6, width adjustment of needle chains 5 or guide rails 6 causes a simultaneous width adjustment of the needling rollers 7. With the embodiment shown in FIG. 1 the support loops 18 of the spreading members have a dog 22 in the vicinity of each edge of the cloth web, which is connected to the guide rail 6 for the corresponding web edge in such manner that adjustment of the width of guide rails 6 or needle chains 5 provides at the same time an appropriate adjustment of the unrolling fingers 16. The control of the chain guide rails 6 and of the elements associated therewith (e.g., needling rollers 7 and unrolling fingers 16) is effected by a device for sensing the edges of the cloth web. In the embodiment shown in FIG. 1 the sensing devices 23 detect the edges of the cloth web 1 on the feed roller (and thus shortly before the needling rollers 7). The detection by each device 23 takes place optically, by means of a beam of light which is reflected by the bare surface of the roller 4 to a photocell. In this case the edges of the cloth web are detected in a section of their path wherein they are running smoothly, so that precise adjustment for the width setting of the needle chains, needling devices and cloth edge spreading members can be provided.

A web of cloth 1 to be treated reaches the feed section of the tentering machine provided by the invention, by first passing for instance over a supply roller 24, a width stretching roller 25, a superimposed pivotally mounted deflector roller 26 and a further spreader roller *25a* disposed farther above, before it reaches the unrolling fingers 16. The close sequence of the unrolling fingers 16, feed roller 4 and needling rollers 7 in the direction of web feed ensures that the web of cloth 1 is gripped on to the needle chains 5 without hanging arcuately across its width, and cannot contract in width again, so that any slipping of the web edges from the needling rollers is effectively prevented. This efficient guidance of the cloth web 1 is further aided if the rollers which deflect the web, e.g., 26 and 25*a* and the unrolling fingers 16 with the feed roller 4 are so disposed in relation to each other that the web 1 passes substantially vertically and then passes almost horizontally between the last deflecting roller 25*a*, the unrolling fingers 16 and the feed roller 4. In this case the generally horizontal plane of the cloth web in the feed section and the feed roller 4 lie above the plane which contains the upper chain guide rail 6.

In the embodiment just described, the needling rollers are carried by the bearing blocks 11 mounted on the corresponding chain rails. In that case the precise adjustment of the peripheral interval between the needling rollers 7 and the feed roller 4 is preferably carried out during assembly in order to allow for extensions which occur in the chain. The attachment between the chain rails and the bearing blocks 11 can be adjustable so that if necessary the peripheral interval between the needling roller 7 and feed roller 4 can be re-adjusted at any time.

It should also be noted that the sensing devices 23 in the vicinity of each edge of the cloth web can be disposed on the bearing block 11 or the lever arm 12 of the corresponding needling device, and that the needling rollers 7 can be raised by a hand lever 27 against the tension of the spring 13, in order that a new cloth web 1 can be inserted; the resilient and pivotally movable support of each needling roller 7 is also intended to ensure that said roller 7 can deflect should for instance the finger of an operator enter between the feed roller and the needling roller.

Figure 2:
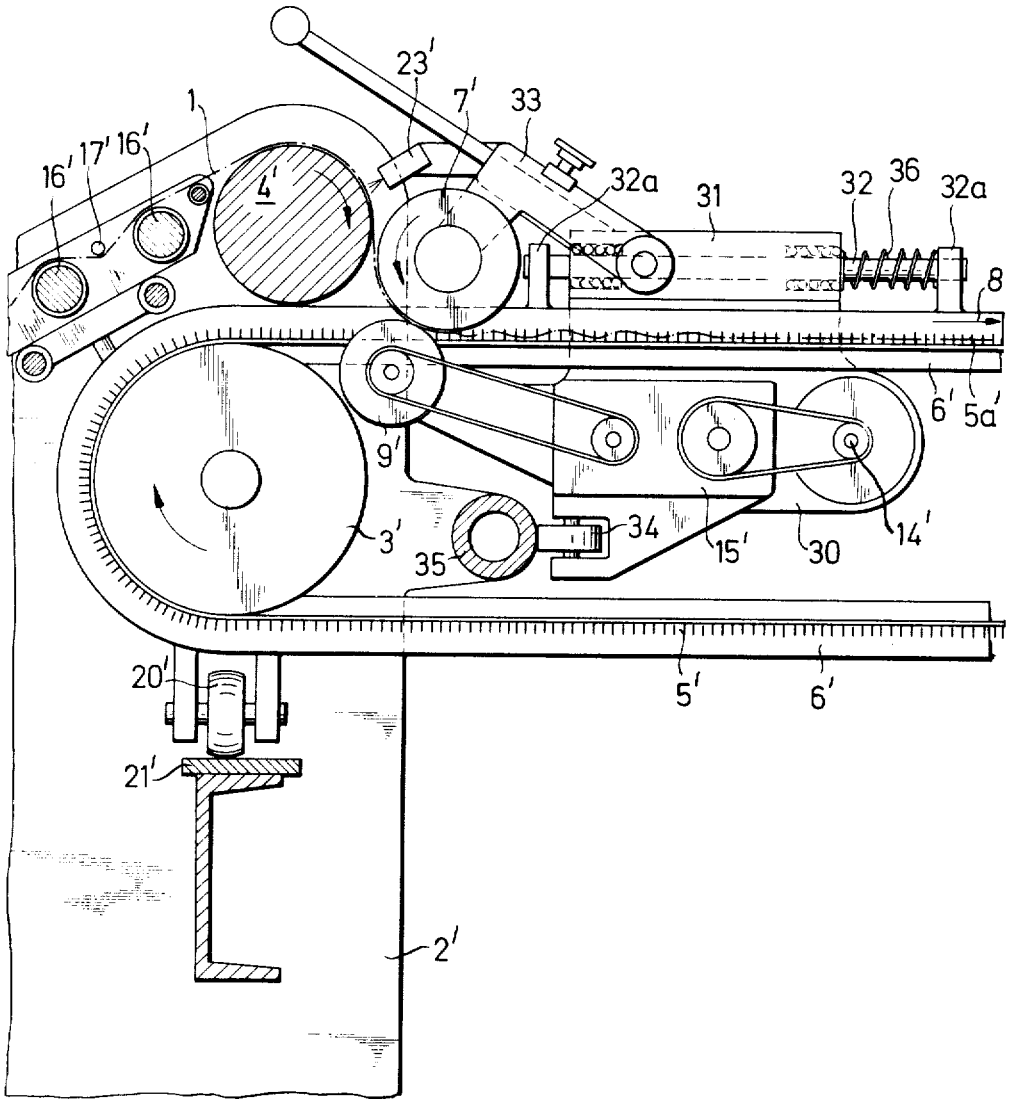
FIG. 2 is a similar section of a second embodiment of the invention, with the two needling devices slidably movable along their corresponding chain rails.

A further embodiment of a tentering machine in accordance with the invention is shown in FIG. 2. The main difference between this embodiment and the tentering machine shown in FIG. 1 resides in the slidably movable mounting of the needling device on the corresponding chain rail; the reference numbers of those parts which are the same in this drawing as in FIG. 1 are for simplicity's sake given the suffix "′", so that detailed description of such parts is unnecessary.

Again in this embodiment the cloth web feed roller 4′ is in the area above the needle chain reverser wheels 3′ which reverse into the inlet portion of the tentering machine the needle chains 5′ and which rotate in chain guide rails 6′ generally perpendicular to the horizontal plane of travel of the web. The chain rails 6′ are adjustable by rollers 20′ on guide tracks 21′ to conform to the different widths of web. The width adjustment of the chain rails 6′ again takes place simultaneously with the width adjustment of the unrolling fingers 16′ for the web edges and of the needling rollers 7′. Control of the width adjustment is again provided by sensing devices 23′ in the same manner as in the first embodiment, i.e., by sensing of the edges of the cloth web on feed roller 4′.

In similar manner to FIG. 1, the drive of each needling roller 7′ is between the upper and lower guide rails 6′ for the corresponding needle chain 5′; it is however not fixedly attached to the chain guide rails 6′. The bearing plate 30 for this drive is carried by a carriage 31 provided with ball mountings which is adapted to slide, longitudinally of the guide rails 6′ on a guide bar 32 which at its ends is fixedly mounted by means of claws 32*a* on the upper guide rail 6′. On the carriage 31 there is again a lever arm 33, which is movably and resiliently supported in similar manner to that in the preceding example.

The needling roller 7′ is again driven frictionally by the counter-pressure roller 9′, which again is mounted on the bearing plate 30; this plate again carries control gearing 15′ incorporated between the counterpressure roller 9′ and the horizontal shaft 14′.

In the lower part of the bearing plate 30 there is mounted a freely rotatable roller 34 engaged with a transverse guide bar 35 which as seen in the direction of web travel lies in the area behind the needle chain reverser wheels, generally parallel with the feed roller 4′, and in a plane extending between the planes of the upper and lower chain guide rails.

On the guide bar 32 between the one holding claw 32a (the right hand claw in the drawing) and the carriage 31 there is a spiral spring 36 which tends to urge the carriage 31 with the needling roller 7′ and the bearing plate 30 towards the feed roller 4′, so that the bearing plate 30 with its roller 34 always is pressed against the transverse guide bar 35.

This arrangement of the needling devices ensures in practice that the peripheral interval between the web feed roller 4′ and the needling rollers 7′ is always kept at the same size, it being immaterial how obliquely (in the lateral direction) the chain guide rails 6′ are set in their entry area, and how much the chain rails have been expanded by heat. The feed roller 4′ and the needling rollers 7′ can thus always be disposed one relatively close behind the other, so that on the one hand the rotary movement of the needling rollers 7′ is independent of the feed roller 4′, while however rolling back of the spread-out edges of the web is reliably prevented. With this embodiment of the tentering machine in accordance with the invention, needling of the cloth web on the tenter chains and their needle members can thus again take place without the web hanging arcuately across its width and with the web completely spread out.

Figure 3:
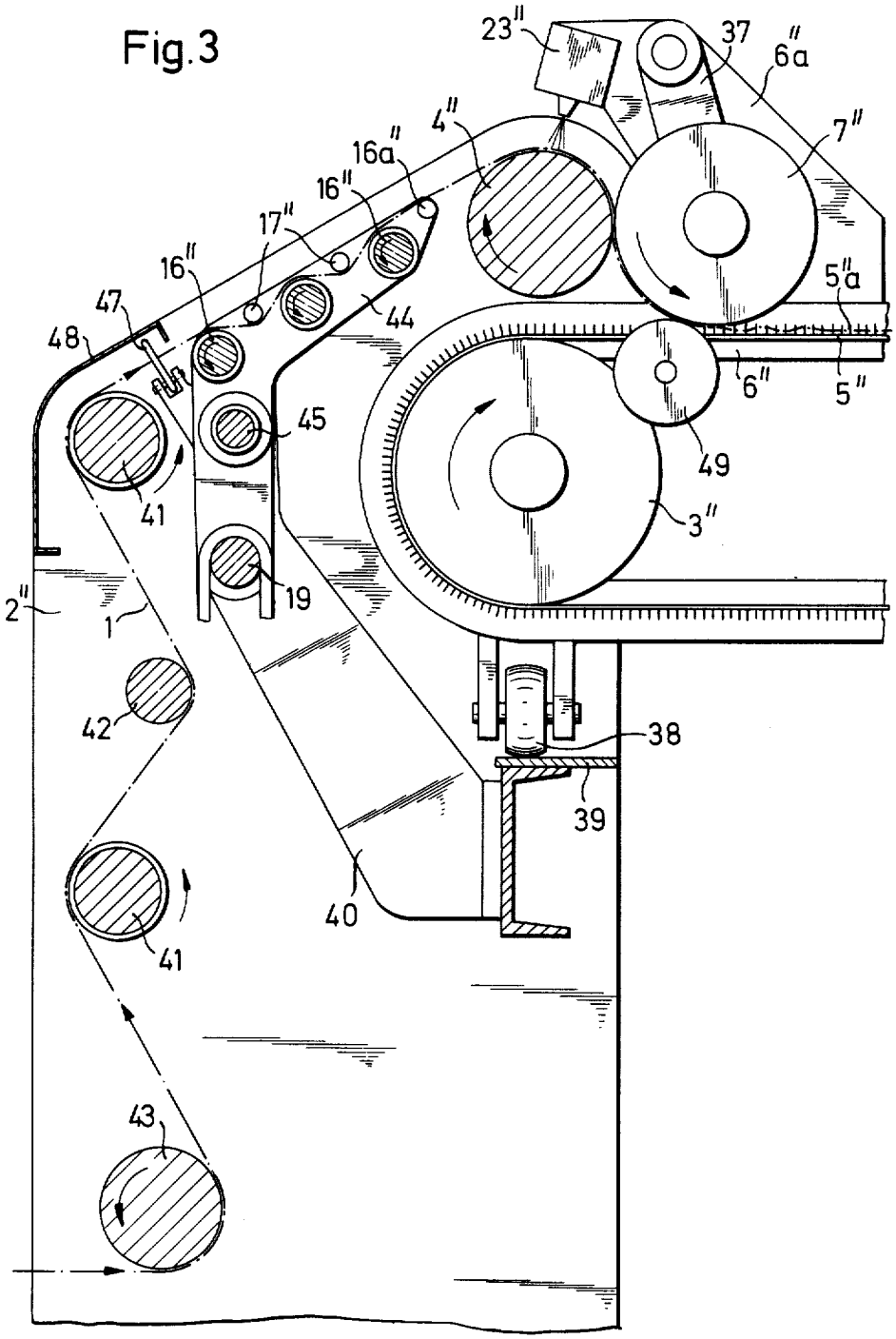
FIG. 3 is a similar section through the feed portion of a further tentering machine in accordance with the invention.

While in the preceding examples the needling rollers are at slight peripheral distance from the feed roller and are each provided with a separate drive, within the scope of the invention the needling rollers may obviously also be in contact with the feed roller over the cloth web, and be driven in this manner. Such an embodiment is shown in FIG. 3. Again for this embodiment parts made in similar manner to those in FIG. 1 are for simplicity's sake given the suffix ″, so that separate description of such parts can be dispensed with.

The web feed roller 4″ is mounted in the top of the frame 2″ before the chain rail entry area in this tentering machine. It is above the reversing wheels 3″ of the tentering chain 5″ with the needle members 5″*a* and hence above the chain rails 6″. The feed roller 4″ can also again be divided axially into a number of roller portions, each being separately driven and adjustable, so that the two outermost roller portions are connected via cloth web 1 with the needling rollers 7″, and so that these can then be separately driven.

In the vicinity of each edge of the web is disposed a needling roller 7″ suspended on a lever 37 carried by a member 6″*a* jointly adjustable with the corresponding chain rail 6″. At its periphery the needling roller 7″ is in contact through web 1 with the periphery of the feed roller 4″ (or with the corresponding outer roller portion of this feed roller) and receives its drive from said feed roller. The needling roller 7″ presses the web edges into the needle members 5″*a*.

The chain rails 6″ are adjustable to the particular width of the web, and run by means of rollers 38 on guide rails 39.

The web 1 is supplied to the feed roller 4'' via width-stretching rollers 41 and a reversal roller 42. A feed roller 43 running in synchronism with the feed roller 4'' may be divided like roller 4'' into several sections, which if necessary can be driven with separate controls.

Between the upper width-stretching roller 41 and the feed roller 4'' are disposed unrolling fingers 16'' between which are adjustable guide bars 17'' which cause a greater or lesser embracement of the unrolling fingers 16'' by the web 1. In order to bring the web effectively unrolled on to the periphery of feed roller 4'', a small unrolling finger 16''*a* is placed in the gap between the last unrolling finger 16'' and the feed roller 4''.

On the right and left edge unrolling device is mounted in bearing loops 44 which can be moved by a setting spindle 45 according to the web width. A guide bar 19 ensures an unchanging position for the device, and is held in the center of frame 2'' in a support 40.

The control of chain rails 6'' and of the elements movable therewith (especially the needling rollers 7'') is again effected by sensing devices 23'', of the optical type, which sense the edges of the web 1 on the periphery of the feed roller 4'' (and hence close before the needling rollers 7'').

In addition coarse adjustment of the unrolling fingers 16'', 16''*a* can be provided by a mechanical feeler 47 below a cover 48 beneath which is also located the top-most width-stretching roller 41. An end switch (not shown) switches off the drive for the adjustment spindle 45 before the unrolling fingers 16'', 16''*a* allotted to the two egdes of the cloth web can collide.

Each needling roller 7'' is preferably associated with a small freely rotating counter-pressure roller 49 which supports the edge of the web, and assists in guiding the web as it is pressed into the needles by the needling rollers 7''.

As compared with the two tentering machines described previously, this third embodiment of the invention is notable for its constructional simplicity.

I claim:

1. A tentering machine for a cloth web, comprising a pair of endless needle chains, each having a driven needling roller cooperating therewith for impaling an edge of the web on an associated needle chain, the two needling rollers being substantially coaxial, and means for adjusting the lateral positions of the needling chains and needling rollers associated therewith, wherein the improvement comprises a. driven feed roller means arranged ahead of and substantially tangent to the needling rollers, and having a web-driving periphery extending substantially continuously across the width of the web, for delivering the web downwardly onto the needling rollers with substantially no intervening gap in which lateral sagging of the web can occur, b. members for spreading the web edges located immediately ahead of the feed roller means, and c. edge-sensing means directed against the periphery of the feed roller means, for sensing the web edges immediately after they have been spread, while the web is supported across its entire width by the feed roller means, and for controlling the means for adjusting the lateral positions of the needling chains and needling rollers associated therewith.

2. A tentering machine according to claim 1 wherein the needling rollers bear against the cloth web on the feed roller means and are thus driven by the feed roller means.

3. A tentering machine according to claim 1 wherein the members for spreading the web edges include edge unrolling devices arranged beneath the web and at each edge thereof.

4. A tentering machine according to claim 3 comprising means for laterally adjusting the edge unrolling devices independently of the needling rollers.

5. A tentering machine according to claim 3 wherein a mechanical feeler for sensing an edge of the web and controlling the lateral adjustment of an edge unrolling device precedes each such device.

6. A tentering machine according to claim 1 wherein a pair of reversing wheels are provided to guide the needle chains, and the feed roller means is located above the reversing wheels.

7. A tentering machine according to claim 1 wherein mechanism is provided for driving the needling rollers at a speed proportional to that of the feed roller means.

8. A tentering machine according to claim 7 wherein the driving mechanism comprises a variable speed drive associated with each needling roller.

9. A tentering machine according to claim 1 wherein each needle chain is provided with a laterally adjustable guide rail, in which the needle chain runs, and each rail carries a pivoted lever that suspends one of said needling rollers.

10. A tentering machine according to claim 9 including a transverse rail, a carriage slidably mounted on each guide rail, each carriage pivotally mounting an associated needling roller suspending lever, and a roller on each carriage for engagement with the transverse rail.

* * * * *